US009771784B2

(12) United States Patent
Ely

(10) Patent No.: US 9,771,784 B2
(45) Date of Patent: Sep. 26, 2017

(54) METHOD FOR RE-STIMULATING WELLS WITH HYDRAULIC FRACTURES

(71) Applicant: Ely and Associates Corporation, Houston, TX (US)

(72) Inventor: John W. Ely, Montgomery, TX (US)

(73) Assignee: Ely and Associates Corp., Houston, TX (US)

( * ) Notice: Subject to any disclaimer, the term of this patent is extended or adjusted under 35 U.S.C. 154(b) by 40 days.

(21) Appl. No.: 14/921,014

(22) Filed: Oct. 23, 2015

(65) Prior Publication Data

US 2017/0114624 A1 Apr. 27, 2017

(51) Int. Cl.

| | |
|---|---|
| ***E21B 33/13*** | (2006.01) |
| ***E21B 43/26*** | (2006.01) |
| ***E21B 43/14*** | (2006.01) |

(52) U.S. Cl.

CPC ..... *E21B 43/261* (2013.01); *E21B 33/13* (2013.01); *E21B 43/14* (2013.01)

(58) Field of Classification Search

CPC ..... E21B 33/138; E21B 23/04; E21B 33/12; C09K 8/50; C09K 8/62

See application file for complete search history.

(56) References Cited

U.S. PATENT DOCUMENTS

| | | | | |
|---|---|---|---|---|
| 4,716,964 | A | 1/1988 | Erbstoesser et al. | |
| 2010/0200235 | A1* | 8/2010 | Luo | C09K 8/50 166/284 |
| 2013/0292123 | A1* | 11/2013 | Murphree | E21B 34/14 166/308.1 |
| 2015/0129207 | A1* | 5/2015 | Bastuba | C09K 8/467 166/250.01 |

OTHER PUBLICATIONS

Perf Sealers LT; Website: www.perfsealers.com; Oct. 2015.
SPE 140529; "The Use of Sealing Ball Staged Fracturing"; Xingzun Wang, et al; Copyright 2011, Society of Petroleum Engineers.
SPE Production and Operations; "Experimental and Field Data Analyses of Ball-Sealer Diversion"; M. Nozaki, D. Zhu and A. D. Hill, Texas A&M University; Aug. 2013.
SPE Production and Operations; "A New Way of Staged Fracturing Using Ball Sealers"; Da Wang et al; University of Houston; Aug. 2012.

* cited by examiner

*Primary Examiner* — Zakiya W Bates
(74) *Attorney, Agent, or Firm* — Claude Cooke, Jr.; Cooke Law Firm

(57) ABSTRACT

A method for re-fracturing of wells having perforated casing that were previously fractured is provided. The method employs degradable ball sealers having a density near that of the injection fluid such that high seating efficiency of balls on perforations is attained. The balls degrade at varying rates, so that some intervals are opened for fracturing while other intervals are still blocked by ball sealers. After fracturing of an interval, the interval may by shut-off by ball sealers that degrade at a much slower rate or that do not degrade. The method may be applied to proppant fracturing or acid fracturing.

20 Claims, 7 Drawing Sheets

METHOD FOR RE-STIMULATING WELLS WITH HYDRAULIC FRACTURES

BACKGROUND OF INVENTION

1. Field of the Invention

Method for increasing (stimulating) the production rate of wells. More particularly, method is provided for re-stimulating the production rate of wells that have been previously hydraulically fractured.

2. Description of Related Art

In recent years new methods have revolutionized recovery of oil and gas from reservoirs. Prior methods could not recover hydrocarbons at an economic rate from the low-permeability rocks being drilled. The combination of drilling wells in a horizontal direction in shales or other low-permeability rocks and then hydraulically fracturing at intervals along the horizontal wellbore opened a whole new resource base in the industry. Typical wells are drilled from about 2000 to about 10000 ft. in the horizontal direction, but may extend much farther, and, in one common method of completing the well, perforations through casing are formed in clusters and the clusters are placed 200 to about 400 feet apart along the horizontal segment of the wellbore. Clusters of perforations may be 10-30 feet apart and the number of perforations may vary widely. A well may have more than 1000 perforations. In this "perf and plug" method of completion, a first cluster of perforations is formed near the "toe" (distal end) of the casing, a hydraulic fracturing treatment is performed through the cluster or perforations, a mechanical plug is set above that cluster of perforations, another cluster of perforations is formed above the plug and then another fracturing treatment is performed through the new set of perforations. This process may be repeated in a single well numerous times—up to 30 or 40 times or more is not highly unusual in some reservoirs. When all fracturing has been completed and plugs are removed from the wellbore, high production rates from the well may be realized.

Not only has there has been a massive amount of stimulation of long productive intervals in reservoirs in horizontal wells, but there has been continuing drilling and fracturing of thick formations in vertical wells. These wells combined have, in fact, turned the U.S. oil industry around, stemming the decline of daily oil and gas produced.

Almost by definition fracture-treated wells using proppant will, at some point, require re-stimulation. There are many reasons for this necessity. They include movement of fines in the fracture, plugging off the conductive flow path. Other reasons include deterioration of proppant, which may include crushing or simply dissolution of the proppant through produced water. Embedment with time into the fracture face, as well as scale deposition in the conductive pathways, also requires reopening fractures and reestablishing the tremendous surface area required to be able to produce hydrocarbons at economic rates from low-permeability reservoirs. Re-stimulation has been shown to be very effective in some proppant-treated wells, achieving significant amounts of production that otherwise would be lost. But the process is limited by the fact that most of these wells are left after the stimulation with hundreds if not thousands of perforations, which, using conventional techniques, prevents successful re-stimulation of these wells because the re-stimulation fluid cannot be directed into selected intervals short enough to achieve fracturing rates in the interval. Although proppant fracturing is described in detail herein, it should be understood that the same procedures described here may be applied in wells that have been acid fractured.

Commonly used techniques to control fluid flow through perforations in casing into selected intervals are ball sealers and particulate diverting materials (fiber and granules). These techniques are helpful when the number of perforations is limited to the range of dozens, but when the number of perforations is large, as in most re-stimulation treatments, ball sealers fail due to low velocity (the balls do not seat). Particulate diversion techniques do not appear to produce seals that are competent enough to allow for successful diversion of fractures into multiple intervals.

Much effort has been put forward to try to re-fracture these long perforated laterals utilizing many different types of particulate- and fiber-based diverting agents. These types of products have been a part of the industry for more than fifty years and field results do not indicate optimal stimulation. The primary problem is believed to be the lack of control of the material once through fractured perforations. Although they may temporarily divert the fluid, they typically break down and any diversion is lost. Additionally the approach used by operators is to attempt to treat a part of the interval with all of the interval open and then divert away from that stage to another. Field results have indicated minimal re-stimulation results, with most of the treatment being utilized at the heel of the lateral.

Ball sealers made of solid material (polymer) that degrades under downhole temperatures and in the presence of water have long been known (U.S. Pat. No. 4,716,964). Commercial ball sealers made of degradable materials are available in industry from Perf Sealers of Houston, Tex., or Fairmount Santrol. Degradable polymers such as polylactic acid and polyglycolic acid degrade (de-polymerize) in water at a rate dependent on temperature. Polymers can be selected to degrade over a range of temperature and time, as illustrated by ball sealers sold by Perf Sealers and designated as "LT" (low temperature), "MT" (medium temperature) and "HT" (high temperature. Degradable ball sealers are available with a range of densities, including densities approaching the density of a treatment fluid to be pumped into a well, according to Perf Sealers' web site It has been shown that matching the density of ball sealers to fluid density and injecting a mixture of balls having a range of densities can greatly increase the seating efficiency of ball sealers on perforations in a horizontal wellbore. (http://www.perfsealers.com/multi-density-perf-sealers, searched Oct. 1, 2015, citing "A New Way of Staged Fracturing Using Ball Sealers," SPE 140529, May 2012, and "Experimental and Field Data Analysis of Ball Sealer Diversion," SPE 147632, March 2013.)

In recent years methods of real-time monitoring the hydraulic fracturing process in a well have been developed and commercialized. Such services are available from Pinnacle, Microseismic Inc, and Weatherford, for example. Microseismic methods allow the location of the hydraulic fracture being formed to be mapped in real time at the surface of the earth. Detectors for the acoustic waves from the fracturing process may be on the surface of the earth or downhole in a well near the well being fractured or in the well being fractured.

What is needed is a method of using ball sealers having selected degradation times and densities to allow re-fracturing of multiple segments of a well that has previously been fractured in multiple segments. In one embodiment, a monitoring method to detect the location of fractures from a well may be used during the fracturing process involving injection of degradable ball sealers.

BRIEF SUMMARY OF THE INVENTION

The present invention relates to the use of degradable ball sealers having a range of degradation rates in combination with ball densities to provide high efficiency of seating of balls on perforations. High seating efficiency of ball sealers allows for isolating perforated intervals in either a long horizontal lateral or a thick vertical section with multiple completions (spaced apart perforations or clusters of perforations). A range of degradation times of the ball sealers seating in the different intervals allows the perforations in different intervals to open at different times, allowing for treatment of either the zones near the toe or the heel or at locations in between of a horizontal well or the deepest or shallowest or in between zones in a vertical well as the ball sealers in that interval degrade. There are available in the industry ball sealers having controlled times of degradation at selected temperatures that can temporarily plug off intervals in a vertical well or intervals in a horizontal lateral where ball sealers seat on the perforations. In one embodiment, this process uses a technique that treats the well selectively by shutting off, temporarily, most or all the spaced-apart zones in the well and then subsequently, as ball sealers degrade earlier in zones that have the most rapid degradation, allows fracturing treatments to be performed in those zones. Ball sealers having as many as 10 or more different degradation times may be used in a single well. Each zone may then be isolated by long-lived or non-degradable ball sealers after it is fractured. In another embodiment, the fracturing process is monitored by instrumentation and multiple ball drops are made to maximize fracturing along the wellbore. There are multiple real-time techniques to monitor the success of this process, which include friction pressure calculations at the surface, microseismic observation during fluid injection and an electromagnetic process known as the eEM system. By monitoring all of the above the staging or sequencing of the treatments can be accomplished with precision. The staging of either biodegradable or time-settling ball sealers can be alternated based on results of diagnostic techniques.

BRIEF DESCRIPTION OF THE SEVERAL VIEWS OF THE DRAWING(S)

DETAILED DESCRIPTION OF THE INVENTION

Figure 1:
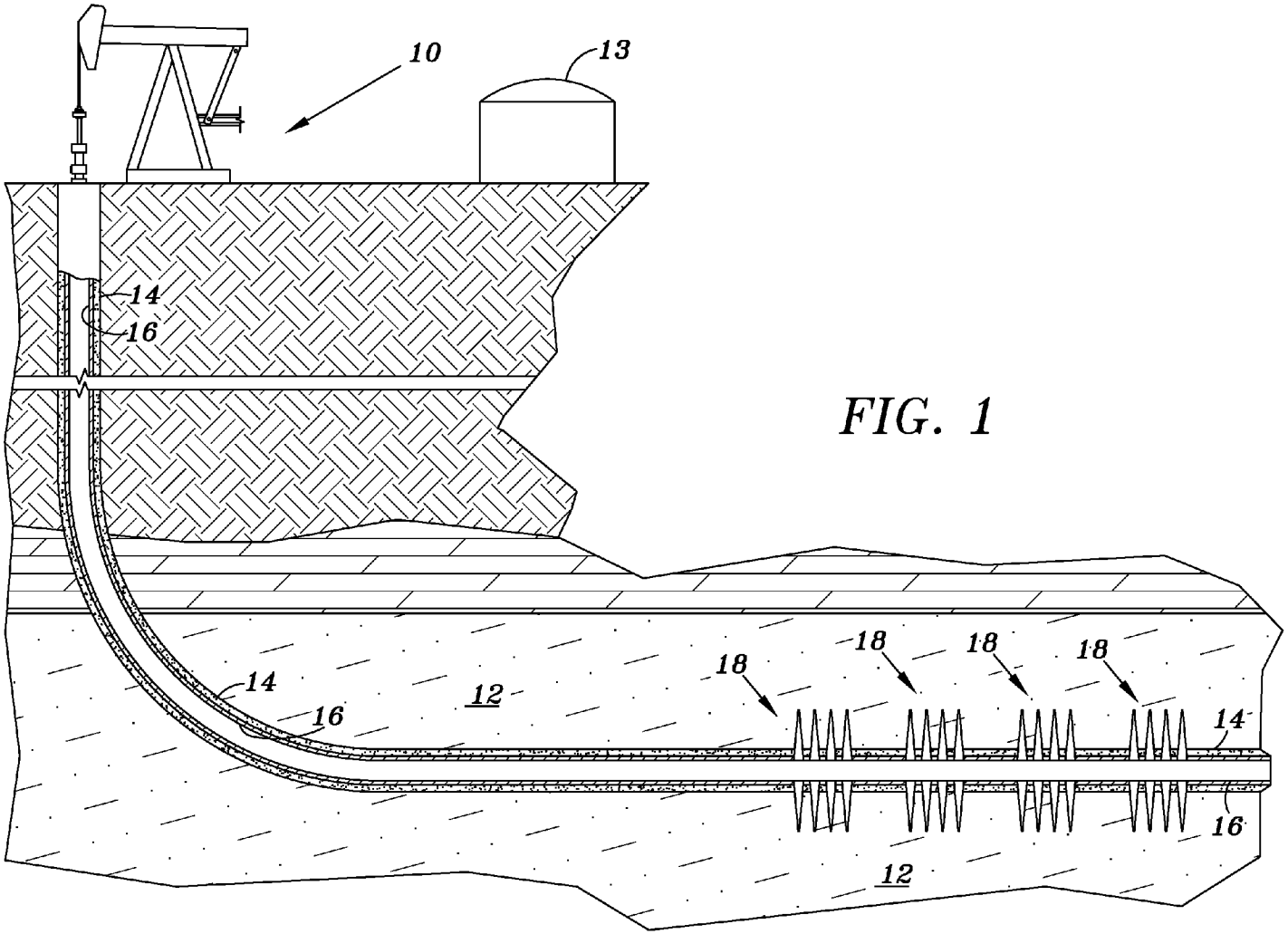
FIG. 1 is a cross-section view of a horizontal well drilled and completed through a reservoir with multiple clusters of perforations in the casing of the well.

Referring to FIG. 1, well 10 is shown drilled with a horizontal segment in reservoir 12. Casing 16 has been placed in the wellbore and cement 14 pumped into the well to seal the annulus between casing and the wall of the wellbore. Perforations 18 have then been formed sequentially during the completion process of the well, usually using a well-known process (often called "perf and plug") that involves sequential formation of clusters of perforations 18 beginning from the distal end (toe) of the well. One set of perforations is formed, a fracturing treatment is performed through that set of perforations, then a bridge plug is set in the wellbore above the perforations and another set of perforations is formed. A fracturing treatment is then performed in the well through the second set of perforations. This process may be repeated for dozens of times in long horizontal wells. The plugs are removed from the well after all fracturing treatments are performed and the well is placed on production.

After the "perf-and-plug" method of hydraulic fracturing is used, the plugs are removed and the well is produced, the wellbore condition is as depicted in FIG. 1. The casing in the well contains a large number of perforations, spaced apart over a distance of hundreds or thousands of feet. The production rate of wells completed and fractured as described typically declines at a rapid rate. It is not unusual for the production rate to decline to less than half its initial value within one year. There is then a need to increase production rate from these previously fractured wells. The process to accomplish that is commonly called "re-stimulation" or "re-fracing."

Re-stimulating an existing well by fracturing, however, is more difficult than fracturing during initial completion. To fracture a formation effectively, fluids must be pumped downhole under high pressure, through perforations and into the surrounding formation. On a new well, a single stage is perforated and fractured at a time beginning at the toe, as described above. In a re-stimulation process, the casing already contains many perforations spread over a large interval. Unless perforations can be isolated or plugged during the treatment, pressure applied during the fracturing process is distributed across the entire perforated segment of the well, which results in practically no new fracturing activity during injection of fracturing fluids. The key to re-fracturing a producing well is to close off most of the perforations at a time when a treatment is to be performed, which reduces the surface area of the exposed formation and increases the pressure on the open areas.

The method disclosed herewith employs buoyant or floating ball sealers or ball sealers having a specific gravity very near that of the injection fluid used to treat a well. Batches of these ball sealers that may have different rates of degradation under conditions in the wellbore are injected. Some ball sealers may have a very slow rate of degradation, degrading in the well over many hours or even days. Other ball sealer may degrade at wellbore conditions within a few hours. Degradable ball sealers are commercially available with a broad range of degradation times over a range of wellbore temperatures.

In preparation for the process described herein, system 13 (FIG. 1) is preferably installed to monitor the fracturing process in the well being re-stimulated. System 13 may be a microseismic system, which is commercially available from Pinnacle (a Halliburton Company), Microseismic Inc. or others, or an imaging system called eEM that is commercially available from Deep Imaging Technologies of Tomball, Tex., or any other system to monitor the real-time formation of a hydraulic fracture around well 10. Detectors may be installed in well 10, in an offset well or at the surface around well 10.

In preparation for the fracture treatment, degradable ball sealers may be injected into a well using commonly available ball injection apparatus. The ball sealers are pumped downhole with the conveying fluids at pressures that fracture at least one interval in the well. They follow the path of the conveying fluid and may get lodged in the first perforations they come to where fluid is flowing through the perforations—blocking the flow through those perforations, or they may seat in perforations farther down the well. It is usually not possible to predict a priori where the ball sealers will seat.

Figure 2:
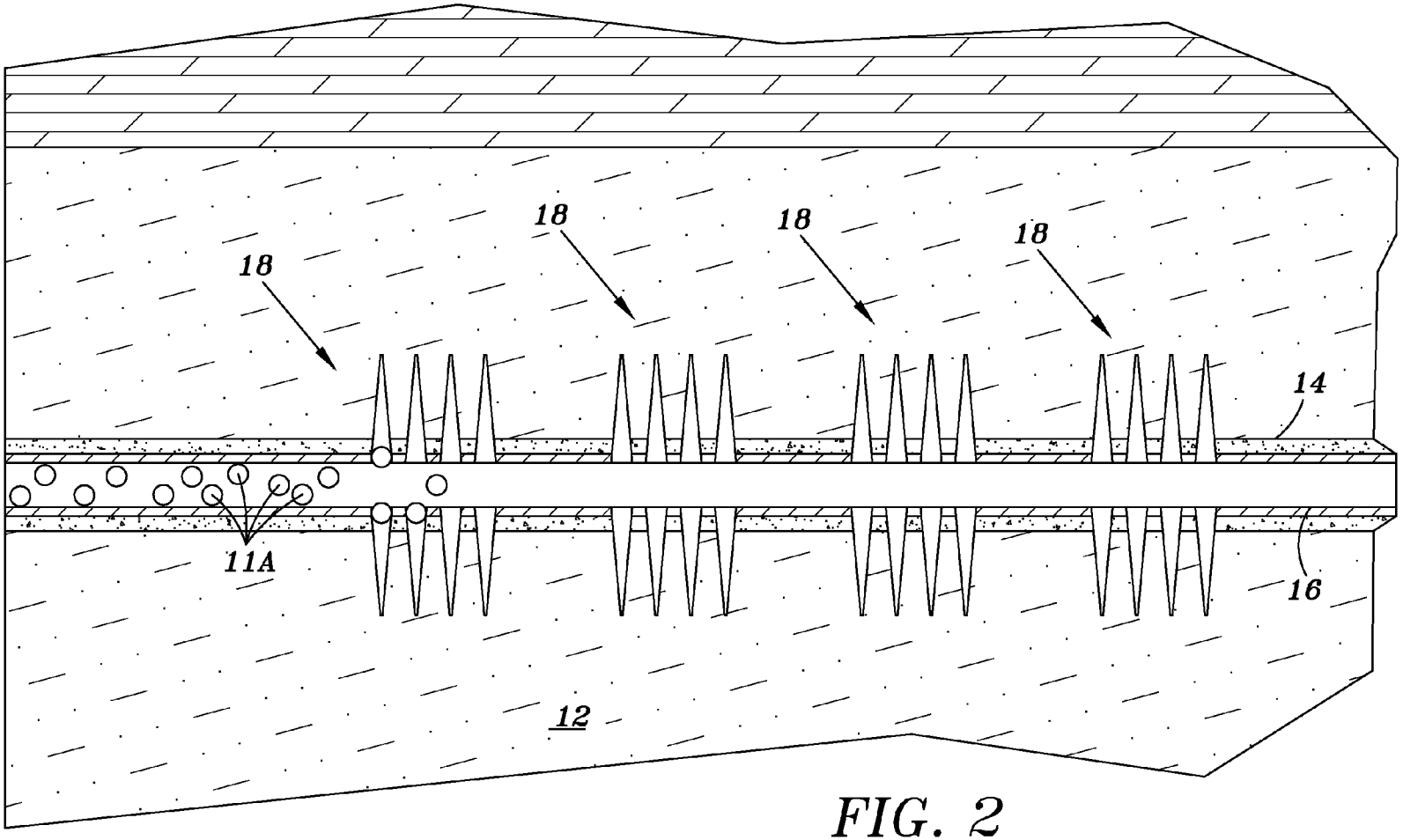
FIG. 2 illustrates the horizontal well of FIG. 1 during first injection of degradable ball sealers into the well for re-fracturing.

FIG. 2 illustrates ball sealers 11A, having the longest degradation time under wellbore conditions of all ball sealers to be injected, arriving at the first cluster of perforations and beginning to seal perforations in that interval. The ball sealers may not seat on the first perforations, but are much more likely to seat on the first perforations where fluid is flowing through perforations and fracturing the adjoining rock. Although FIG. 2 illustrates ball sealers seating in the first cluster of perforations, it should be understood that the location of the perforations where ball first seat may be anywhere along the wellbore.

During the pumping of fluid and first fracturing, monitoring system 13 is preferably used to determine which interval of the well is being fractured. Alternatively, calculations of pressure drops through perforations may be used to analyze the fracturing process, using methods well known in industry.

There are multiple scenarios relating to the use of the combination of both "time and temperature buoyant degrading ball sealers" and "non-degrading balls which lose their buoyancy" in the re-stimulation process. The term "buoyant ball sealers" or "floating balls" is used to designate ball sealers having a specific gravity within a selected range of the specific gravity of the fluid carrying the ball sealers down the wellbore. Balls may be selected with different ranges of specific gravity differences by allowing balls to segregate in a fluid having a selected specific gravity. A range of differences of 0.2, 0.1 0.05 and 0.02 may be selected for batches of buoyant or floating balls, for example.

A range of degradation-time of balls can be pumped at fracturing rate to achieve a near ballout. This will allow for treatment of a specific interval with a large stage fracture treatment. At the end of the treatment a sufficient number of the non-degradable floating balls can be used to plug off the section treated until the entire lateral is stimulated.

When the shortest degradation set of balls has degraded, another fracturing stage will be initiated and pumped to completion followed by non-degradable floating balls to seal off the second stage. This process may be repeated until the entire section is treated.

For various reasons it is possible that the degradable balls will break down earlier than anticipated and more time-degradable balls will be required to temporarily shut-off the section of the lateral prior to stimulation. Any breakdown can be observed using microseismic and or eEM. Where microseismic and eEM are not available, the process can be conducted utilizing well-known calculations of perforation friction. This process without surface observation or monitoring, although not optimum, is expected to be superior to diversion techniques using fiber or particulate material.

The process disclosed herein will be very dynamic, since it is unknown what intervals were actually treated in the initial fracturing of a well. Therefore, multiple iterations of ball drops with various degradation levels may be required in the present process.

After fracturing subsides or ceases in the first interval after ball sealers have stopped flow into that interval, pumping is continued to begin fracturing in another interval, which is monitored by monitoring system 13. Each round of ball sealers injected may be selected to degrade in progressively shorter time duration after they block perforations. Alternatively, each round of ball sealers injected may be selected to degrade in progressively longer time duration after they block perforations. If the nearest open perforations are blocked with each subsequent round of ball sealers, the sealers closest to the toe may break down the fastest or break down first. Ball sealer injection may continue until the well is "balled out," meaning that the maximum rate of fluid injection is very low, for example, less than 5 barrels per minute or even 1 barrel per minute. With microseismic, an electromagnetic imaging system or good information on friction pressure losses in pipe and perforations, it may be desirable to initiate the first fracturing treatment through perforations that have not received ball sealers. After this first treatment, non-degradable balls are dropped, degradable balls are dropped and time for degradation of degradable balls is allowed before the next treatment is started.

Figure 3:
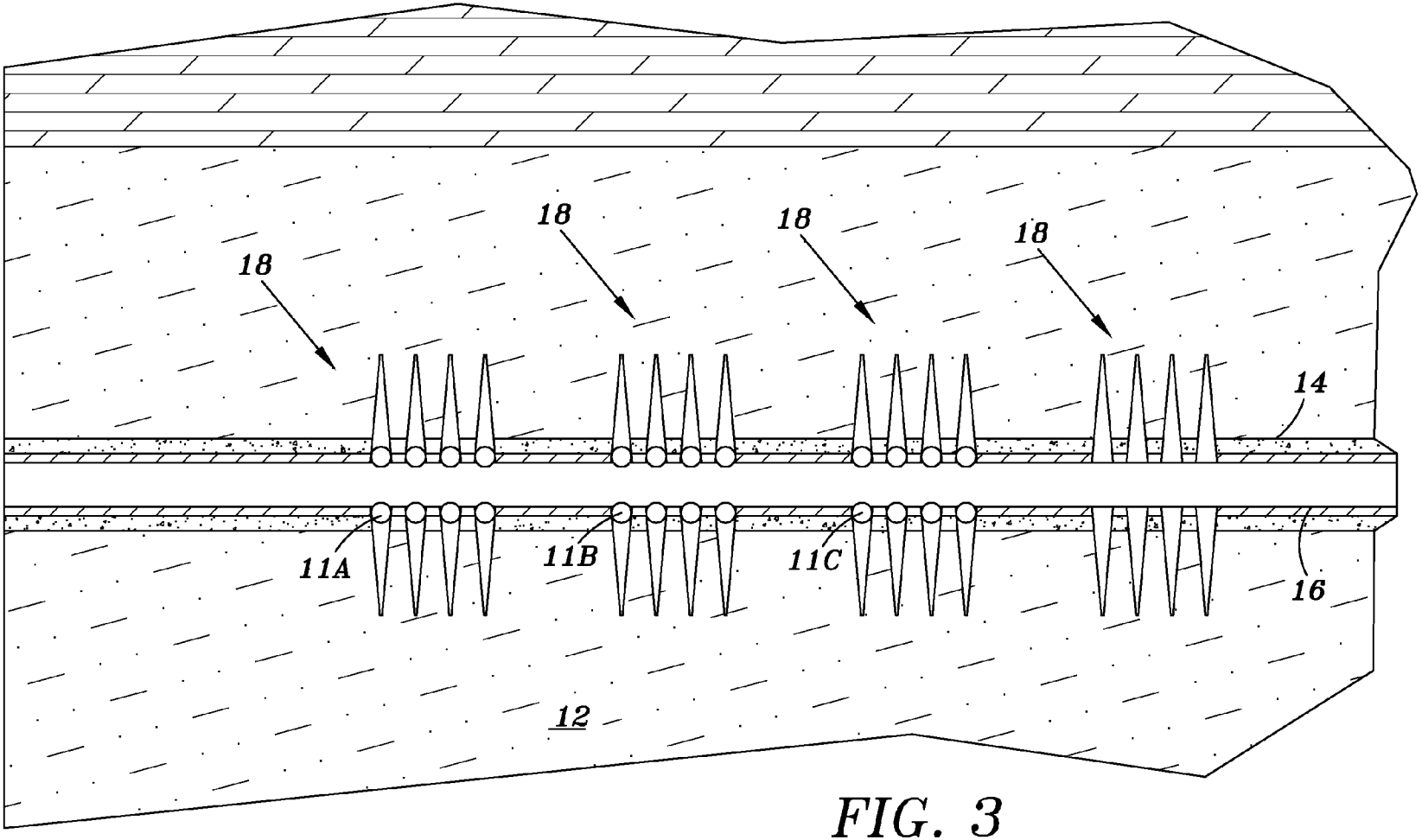
FIG. 3 illustrates the well of FIG. 2 after the degradable ball sealers in the clusters of perforations nearest the toe of the well have degraded or before ball sealers reach the perforations nearest the toe.

FIG. 3 illustrates that ball sealers 11A, 11B and 11C, having progressively shorter or progressively longer degradation times, have sealed three sets of perforations at increasing distance from the heel of the well. The last cluster of perforations, nearest the toe of the well, may have been sealed by ball sealers 11D, having the shortest degradation time of all ball sealers injected, but sealers 11D are not shown because if they were injected they have degraded. The perforations in that segment may have been opened by the degradation of ball sealers that were originally in that interval. Alternatively, injection of balls may have been stopped before blocking that interval.

Figure 4:
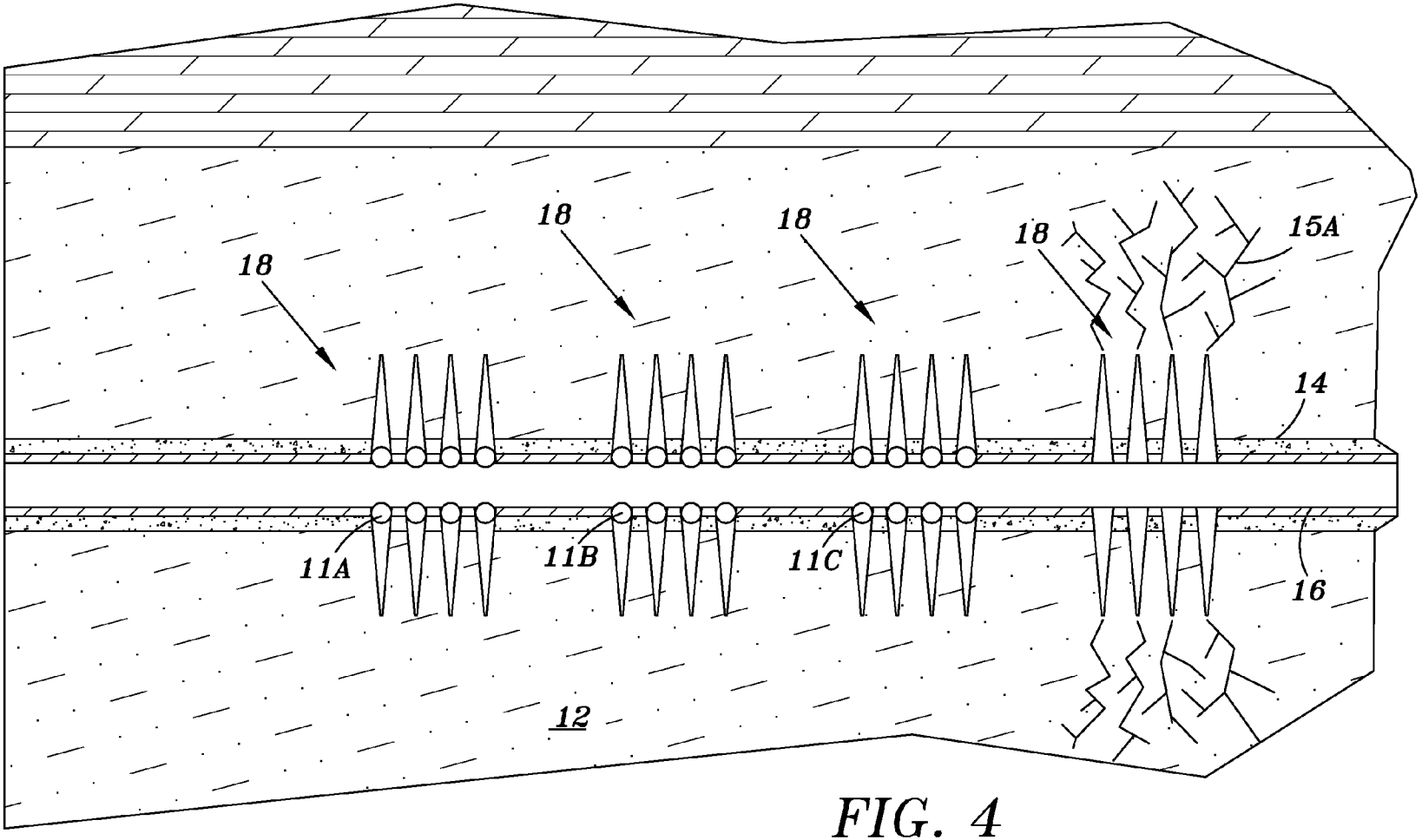
FIG. 4 illustrates the well of FIG. 3 while fracturing the interval nearest the toe of the well after degradation of the sealers in this interval. Micro seismic or other signals may be detected as a result of the fracturing operation.

FIG. 4 illustrates a fracturing treatment being pumped through the farthest set of the perforations, or those nearest the toe of the well. Fracture-affected volume 15A in reservoir 12 has been formed as a result of the first stage of the re-fracturing treatment. Microseismic data may be collected at the surface or in offset wells or in the well being re-fractured to provide better understanding of where each re-fracturing treatment is occurring. Data may also be obtained by electrical or magnetic or any other technique used to detect fracturing in the earth.

Figure 5:
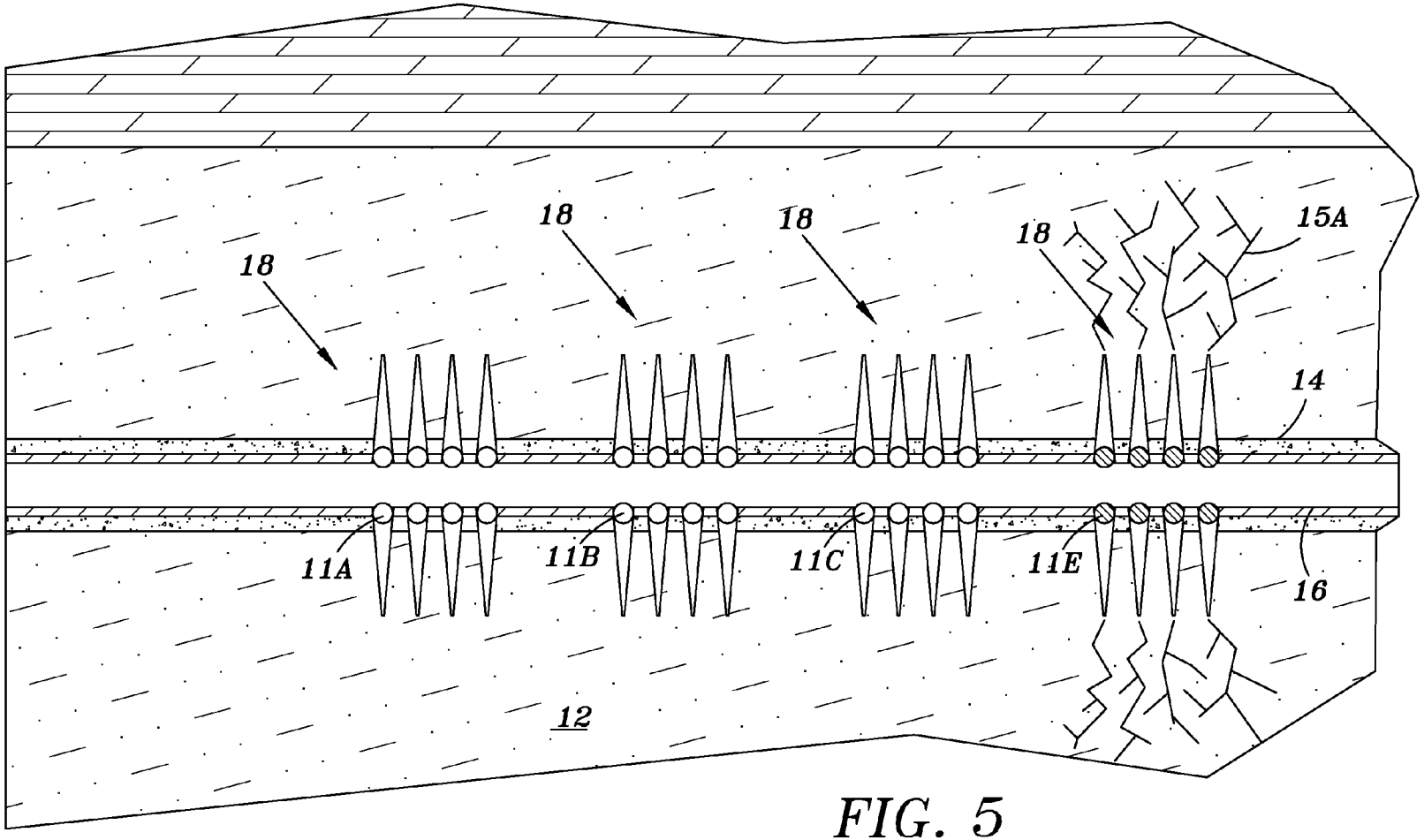
FIG. 5 illustrates the well of FIG. 4 after the fracturing operation and non-degradable or slowly-degradable ball sealers are injected into the well to plug perforations in the interval that has been fractured.

FIG. 5 illustrates the placement of non-degradable or slowly degradable ball sealers 11E into the newly fractured perforations. "Slowly degradable" means that the balls are expected to degrade in a time greater than the total treatment time of all the intervals in a well. After this step the well is prepared for the next fracturing treatment after ball sealers 11C have degraded.

Figure 6:
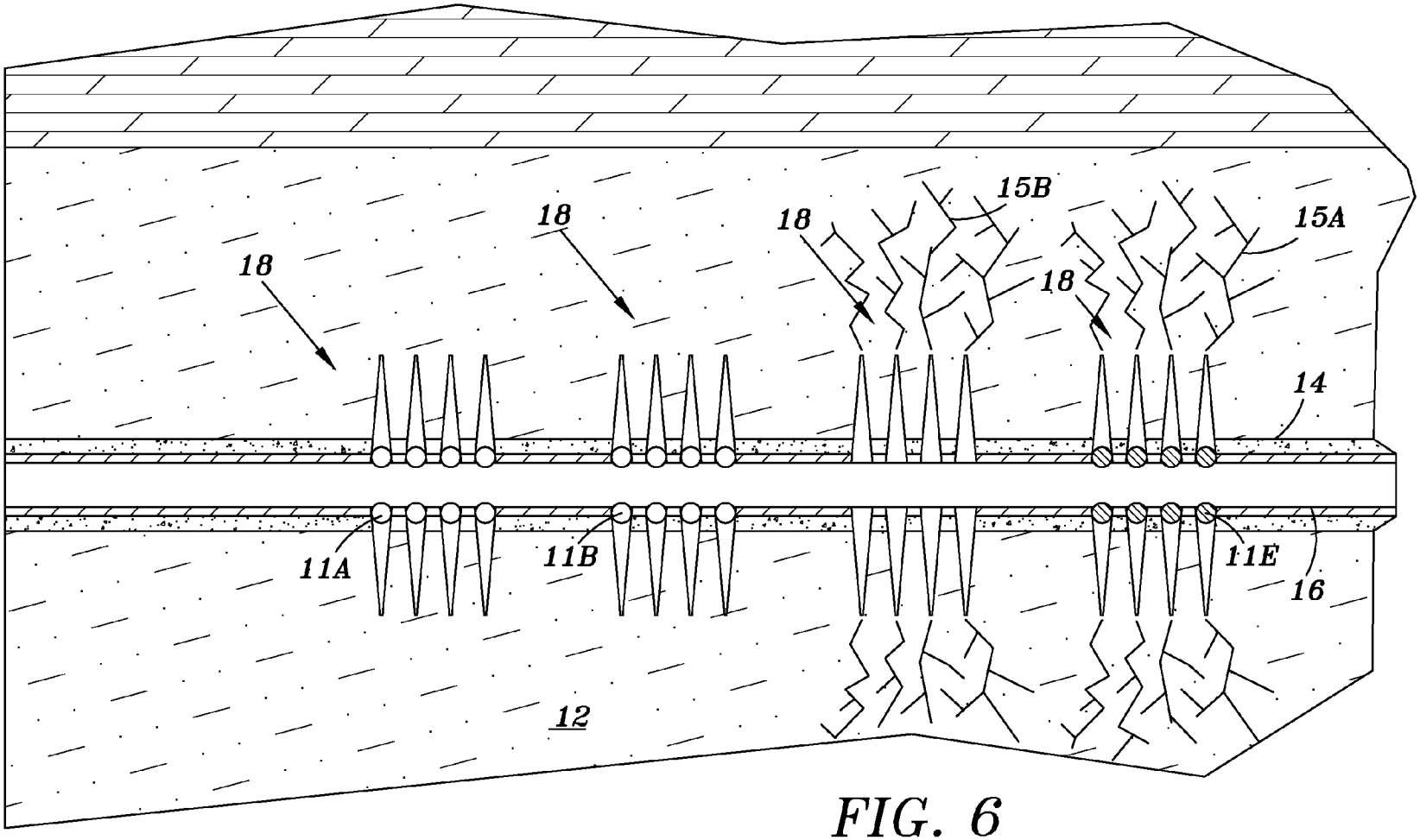
FIG. 6 illustrates the well of FIG. 5 after ball sealers in the interval adjacent to the most remote cluster of perforations is opened by degradation of the ball sealers and fracturing is initiated in this interval.

FIG. 6 illustrates that the ball sealers 11C have degraded in another cluster of perforations, displaced from the distal set of perforations and a second fracturing treatment may be performed in this interval, forming fracture-affected volume 15B.

Figure 7:
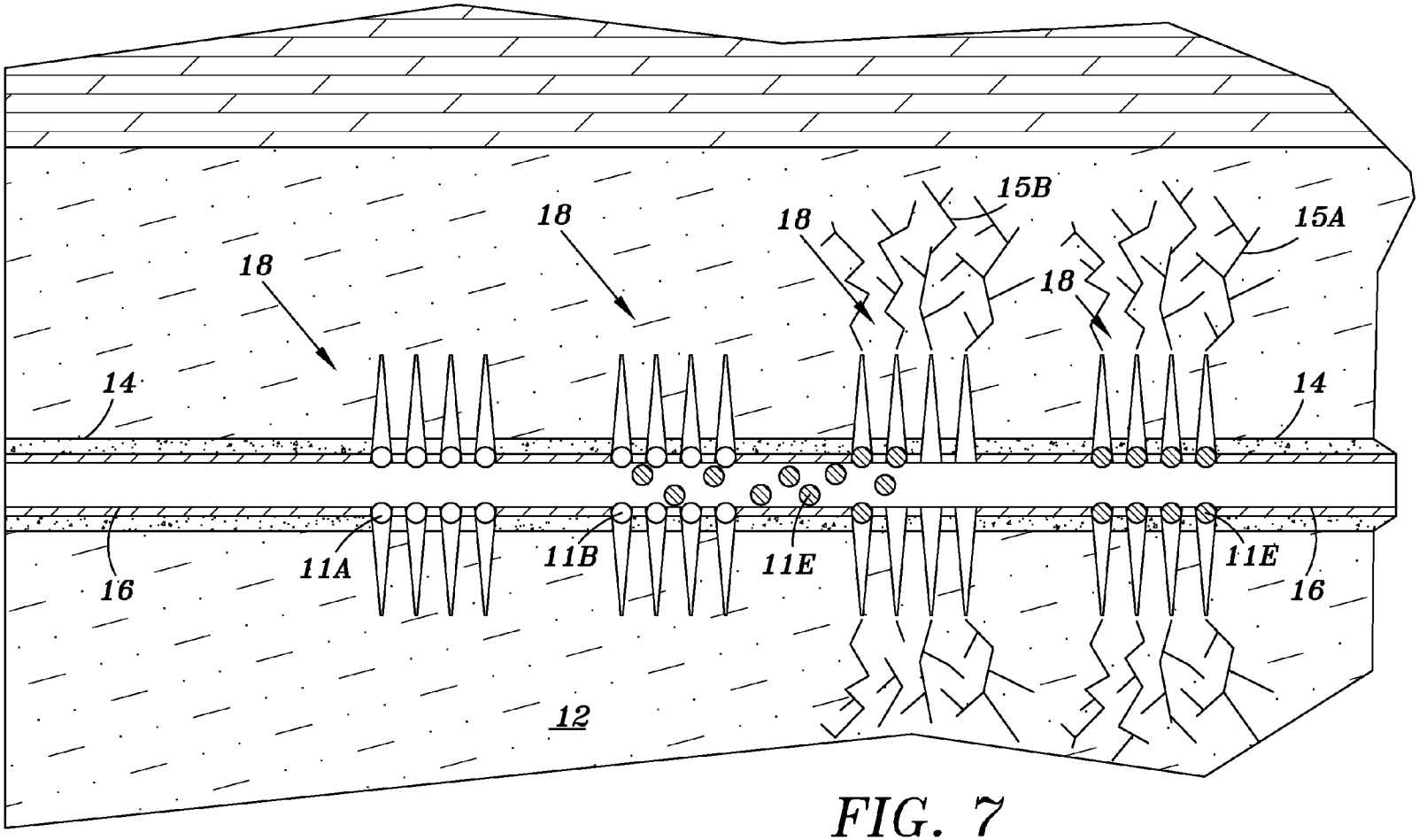
FIG. 7 illustrates the well of FIG. 6 during injection of a batch of non-degradable or slowly degradable ball sealers to close off the second fractured stage.

FIG. 7 illustrates that another batch of non-degradable or slowly degradable ball sealers is injected to close off the second re-fractured interval. The process may be repeated until all intervals have been fractured.

Of course, it should be realized that, although the invention has been described herein as having fracturing treatments proceed from the toe (distal end) or deepest interval of a well successively toward the heel or shallowest segment of a well, the degradation times of ball sealers may be selected such that the most rapidly degrading ball sealers are pumped first and the first fracturing treatment is pumped into the zone where these ball sealers have seated, the nearest interval. Then this interval may be isolated by long-life or slowly degradable ball sealers and the next interval be fractured. In most wells this procedure would require longer degradation times of the different stages and, therefore, it would not be the preferred procedure.

The non-degradable or slowly degradable ball sealers will eventually degrade in the perforations or wellbore, leaving open fractures with greatly increased productivity, or they may be produced back to surface and collected using conventional ball-catching equipment.

The degradation time of a ball sealer in perforations may be determined by placing the ball sealer in a real or simulated perforation in pipe with water or brine immersing the ball sealer and with pressure in the water to seat the ball, bringing the water and pipe to a temperature expected in a well and observing the pressure behavior of water in the pipe. Other well-known similar techniques may be used to simulate conditions in a well after ball sealers are injected. The ball sealer is considered to have degraded when the flow resistance through the perforation is less than double the resistance in the absence of a ball sealer.

Although the present invention has been described with respect to specific details, it is not intended that such details should be regarded as limitations on the scope of the invention, except to the extent that they are included in the accompanying claims.

The invention claimed is:

1. A method for applying a multi-stage hydraulic fracturing treatment in a well having a plurality of perforations in casing, the casing extending through multiple intervals in the well, comprising:

injecting a fluid into the well at a rate above the rate required to reach fracturing pressure in at least one interval of the well;

continuing injection of a fluid having a specific gravity and a first number of degradable ball sealers suspended in the fluid, the degradable ball sealers having a first degradation time and a selected specific gravity within a selected range of the value of the specific gravity of the fluid, the first number being selected to seat on and plug the perforations in a stage of a hydraulic fracturing treatment of the well;

continuing injection of a fluid having a specific gravity and a second number of degradable ball sealers suspended in the fluid, the degradable ball sealers having a second degradation time and a selected specific gravity within a selected range of the value of the specific gravity of the fluid, the second number being selected to seat on and plug the perforations in a separate stage of a hydraulic fracturing treatment of the well;

allowing time for the ball sealers in the first or the second interval to degrade to produce a single perforated interval where at least some of the ball sealers placed in the perforations have degraded; and continuing injection of a fluid so as to hydraulically fracture the interval in the well where ball sealers placed in the perforations have degraded.

2. The method of claim 1 wherein the selected range of the value of the specific gravity of the ball sealers is in the range of plus or minus 0.2 of the value of the specific gravity of the fluid.

3. The method of claim 1 wherein the selected range of the value of the specific gravity of the ball sealers is in the range of plus or minus 0.1 of the value of the specific gravity of the fluid.

4. The method of claim 1 wherein the selected range of the value of the specific gravity of the ball sealers is in the range of plus or minus 0.05 of the value of the specific gravity of the fluid.

5. The method of claim 1 wherein the selected range of the value of the specific gravity of the ball sealers is in the range of plus or minus 0.02 of the value of the specific gravity of the fluid.

6. The method of claim 1 further comprising injection of a fluid having a third number of ball sealers suspended in the fluid, the ball sealers being non-degradable or having a third degradation time greater than a time expected to be required to perform a hydraulic fracturing treatment of the multiple intervals of the well and a selected specific gravity within a selected range of the value of the specific gravity of the fluid.

7. The method of claim 6 wherein the third number of ball sealers is within the range of about 25 percent more or less than the first or the second number of ball sealers.

8. The method of claim 1 further comprising monitoring the multi-stage hydraulic fracturing treatment during a time of injection of a fluid.

9. The method of claim 1 further comprising continuing injection of a fluid having degradable ball sealers suspended in the fluid, the degradable ball sealers having a selected degradation time greater or less than the degradation times of the first or second ball sealers and a selected specific gravity within a selected range of the value of the specific gravity of the fluid, the number of ball sealers being selected to seat on and plug the perforations in the well such that the injection rate of the fluid is decreased to less than 1 barrel per minute.

10. A method for applying a multi-stage hydraulic fracturing treatment in a well having a plurality of perforations in casing, the casing extending through multiple intervals in the well, comprising:

injecting a fluid into the well at a rate above the rate required to reach fracturing pressure in at least one interval of the well;

adding batches of degradable ball sealers to fluids being injected into the well, each batch of ball sealers having a specific gravity selected to allow high seating efficiency of the ball sealers on the perforations and a degradation time selected to allow the batches of degradable ball sealers to degrade at different times such that the intervals having the perforations where the degradable ball sealers have degraded can receive a hydraulic fracturing treatment at different times.

11. The method of claim 10 further comprising adding a batch of non-degradable or slowly degradable ball sealers after at least some of the hydraulic fracturing treatments.

12. The method of claim 10 further comprising monitoring the hydraulic fracturing treatment during injection of a fluid.

13. The method of claim 12 further comprising adjusting the time or the number of degradable ball sealers injected into the well in response to the monitoring of the hydraulic fracturing treatment.

14. The method of claim 10 wherein batches of degradable ball sealers are added to fluids being injected into the well until the injection rate into the well at fracturing pressure decreases to less than 5 barrels per minute.

15. The method of claim 10 wherein batches of degradable ball sealers are added to fluids being injected into the well until the injection rate into the well at fracturing pressure decreases to less than 1 barrel per minute.

16. The method of claim 10 wherein batches of degradable ball sealers are added to fluids being injected into the well until the injection rate into the well at fracturing pressure indicates that a number of perforations receiving fluid has been reduced to a number indicating that a single fracturing stage can be conducted in the well.

17. The method of claim 10 wherein the selected value of the specific gravity of the ball sealers is in the range of plus or minus 0.2 of the value of the specific gravity of the fluid.

18. The method of claim 10 wherein the selected value of the specific gravity of the ball sealers is in the range of plus or minus 0.1 of the value of the specific gravity of the fluid.

19. The method of claim 10 wherein the selected value of the specific gravity of the ball sealers is in the range of plus or minus 0.05 of the value of the specific gravity of the fluid.

20. The method of claim 10 wherein the selected value of the specific gravity of the ball sealers is in the range of plus or minus 0.02 of the value of the specific gravity of the fluid.

* * * * *